US006695459B2

(12) United States Patent
Collins

(10) Patent No.: US 6,695,459 B2
(45) Date of Patent: Feb. 24, 2004

(54) PORTABLE LIGHTING PRODUCT, PORTABLE LIGHTING PRODUCT CIRCUITRY, AND METHOD FOR SWITCHING PORTABLE LIGHTING PRODUCT CIRCUITRY

(76) Inventor: John Collins, 1202 W. 86th St., Kansas City, MO (US) 64114

( * ) Notice: Subject to any disclaimer, the term of this patent is extended or adjusted under 35 U.S.C. 154(b) by 127 days.

(21) Appl. No.: 10/109,395

(22) Filed: Mar. 27, 2002

(65) Prior Publication Data

US 2003/0184998 A1 Oct. 2, 2003

(51) Int. Cl.[7] ..... F21L 4/00

(52) U.S. Cl. ..... 362/195; 362/191; 362/226; 362/247; 362/800; 313/318.11; 439/500; 439/180

(58) Field of Search ..... 362/194, 195, 362/191, 800, 396, 226, 247; 313/318.11, 318.12; 439/500, 627, 180, 97

(56) References Cited

U.S. PATENT DOCUMENTS

| | | | | | |
|---|---|---|---|---|---|
| 985,018 | A | * | 2/1911 | Eastman | 439/666 |
| 1,167,707 | A | * | 1/1916 | Mebold | 362/195 |
| 1,248,978 | A | * | 12/1917 | Youmans | 439/627 |
| 4,371,594 | A | * | 2/1983 | Ohara et al. | 429/97 |
| 6,137,396 | A | * | 10/2000 | Puppo | 340/332 |
| 6,511,202 | B1 | * | 1/2003 | Henry | 362/195 |

* cited by examiner

*Primary Examiner*—Sandra O'Shea
*Assistant Examiner*—Ali Alavi
(74) *Attorney, Agent, or Firm*—Wells St. John P.S.

(57) ABSTRACT

A portable lighting product includes a lamp and a lamp holder. The lamp holder has a positive terminal and a negative terminal spaced from the positive terminal for connection with respective terminals on a power source. One of the terminals includes a snap-fitting, pivotable, and electrically conductive battery terminal. Another of the terminals includes an electrically conductive clasp configured to mate in urgable engagement with a terminal of a power source.

33 Claims, 13 Drawing Sheets

PORTABLE LIGHTING PRODUCT, PORTABLE LIGHTING PRODUCT CIRCUITRY, AND METHOD FOR SWITCHING PORTABLE LIGHTING PRODUCT CIRCUITRY

TECHNICAL FIELD

This invention pertains to the field of illumination. More particularly, the present invention relates to a portable lighting product, portable lighting product circuitry, and a method for operating portable lighting product circuitry.

BACKGROUND OF THE INVENTION

There exist numerous hand-held light sources such as miniature lights, hand-held flashlights, and light emitting diode (LED) flashlights. Most devices include a receptacle for containing a replaceable battery power supply. Some devices are disposable, and include an encased, single-use battery.

By way of example, one relatively compact light source from U.S. Pat. No. 6,137,396 to Puppo is illustrated in FIG. 1. More particularly, a miniature battery powered beacon 10 is disclosed in the form of an LED light source 14 surrounded by a body 16 that attaches to battery terminals 22, 24 on a conventional 9-volt battery. The beacon 10 is disclosed for use in dance performance and theatrical production to demarcate locations and/or obstructions on a stage, as well as off the stage. The body 16 uses male and female battery terminals 18, 20 to couple with respective female and male battery terminals 22, 24 on a traditional 9-volt battery 12 by axially inserting respective terminal pairs 18, 22 and 20, 24 together for a snap-fit engagement. However, such battery terminal pairs 18, 22 and 20, 24 are difficult to mate and demate. Furthermore, the female terminals 20, 22 tend to splay open and loosen when mated and demated multiple times with a male member 18, 24, which reduces the desirability of using such terminals 20, 22 to form an electrical connection for turning a light source on and off.

SUMMARY OF THE INVENTION

A compact and reusable portable lighting product provides a snap-fit connection with a female 9-volt battery terminal, uses the female terminal as a pivot point for a switching mechanism, and provides a switch by using an electrically conductive clasp that mates and demates with an adjacent male terminal of a 9-volt battery terminal, as the lighting product is rotated relative to the battery.

According to one aspect, a portable lighting product includes a lamp and a lamp holder. The lamp holder has a positive terminal and a negative terminal spaced from the positive terminal for connection with respective terminals on a power source. One of the terminals includes a snap-fit, pivotable, and electrically conductive battery terminal. Another of the terminals includes an electrically conductive clasp configured to mate in urgable engagement with a terminal of a power source.

According to another aspect, a portable lighting product includes a light source, a pivotal electrical connector, a clip electrical connector, and a support member. The light source has a pair of electrical leads. The pivotal electrical connector communicates with a first electrical lead and is configured to axially mate with a first battery terminal of a power supply. The clip electrical connector is spaced from the pivotal electrical connector and communicates with a second electrical lead. The clip is configured to mate and demate with a second battery terminal of a power supply. The support member carries the pivotal electrical connector, the clip electrical connector, and the light source.

According to yet another aspect, a portable lighting product includes at least one light-emitting diode (LED), conductive circuitry, and a switch mechanism. The at least one LED has a positive lead and a negative lead. The conductive circuitry is carried by a substrate and communicates with the positive lead and the negative lead. The switch mechanism is provided in series with the LED via the conductive circuitry. The switch mechanism includes a pivotal electrical connector and a clip electrical connector. The pivotal electrical connector is configured to mate with a first battery terminal of a battery. The clip electrical connector is configured to mate and demate with a second battery terminal of a battery responsive to rotation of the conductive circuitry and substrate relative to the battery about the pivotal electrical connector.

According to even another aspect, a method is provided for operating portable lighting product circuitry. The method includes: providing a portable lighting product including a lamp on a support member having a pivotable battery terminal and a conductive clasp spaced from the battery terminal, the battery terminal mated in urgable engagement with a female battery terminal of a battery also having a second battery terminal spaced-apart from the female battery terminal; and changing an operating state of the portable lighting product between on and off by rotating the portable lighting product relative to the battery about the pivotable battery terminal to engage and disengage the clasp with the second battery terminal of the battery.

According to yet even another aspect, a portable lighting product is provided for an electrical power source having snap terminals. The portable lighting product includes an electro-optical transducer, a structural member, one mating terminal, another mating terminal, and connective circuitry. The structural member is configured to support the electro-optical transducer. The one mating terminal is configured for mating with one snap terminal of the power source. The another mating terminal is configured for mating and demating with another snap terminal of the power source. The connective circuitry is carried by the structural member for connecting the electro-optical transducer with the one mating terminal and the another mating terminal. The structural member is pivotably free about an axis of the one snap terminal via the one mating terminal. The structural member includes a switch for opening and closing a circuit with the another mating terminal by pivoting the structural member about the one snap terminal to mate and demate respectively via the another mating terminal with the another snap terminal of the power source.

BRIEF DESCRIPTION OF THE DRAWINGS

Preferred embodiments of the invention are described below with reference to the following accompanying drawings.

FIG. 9 is a perspective view of the portable lighting product of FIG. 8 and positioned in a closed switch configuration corresponding with the portable lighting product being turned on.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Reference will now be made to embodiments of Applicant's invention. Several exemplary implementations are described below and depicted with reference to the drawings comprising a portable lighting product and circuitry, shown in six distinct configurations. While the invention is described by way of several preferred embodiments, it is understood that the description is not intended to limit the invention to such embodiments, but is intended to cover alternatives, equivalents, and modifications which may be broader than the embodiments, but which are included within the scope of the appended claims.

Figure 1:
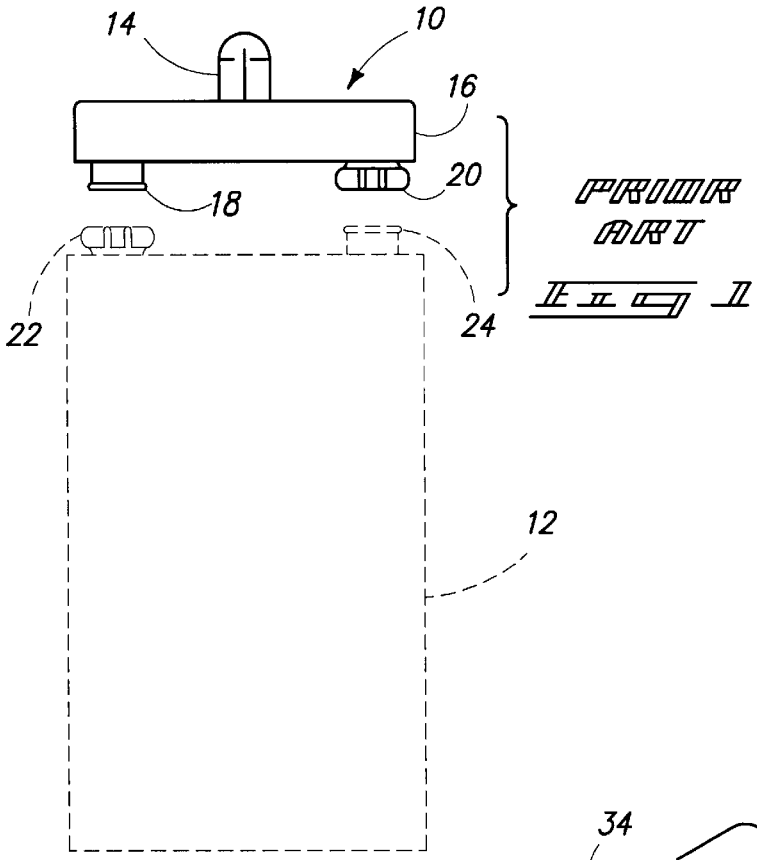
PRIOR ART Fig 1
FIG. 1 is an elevational view of a prior art lighting product in the form of an LED beacon showing connection with a traditional 9-volt battery shown in phantom.
Figure 2:
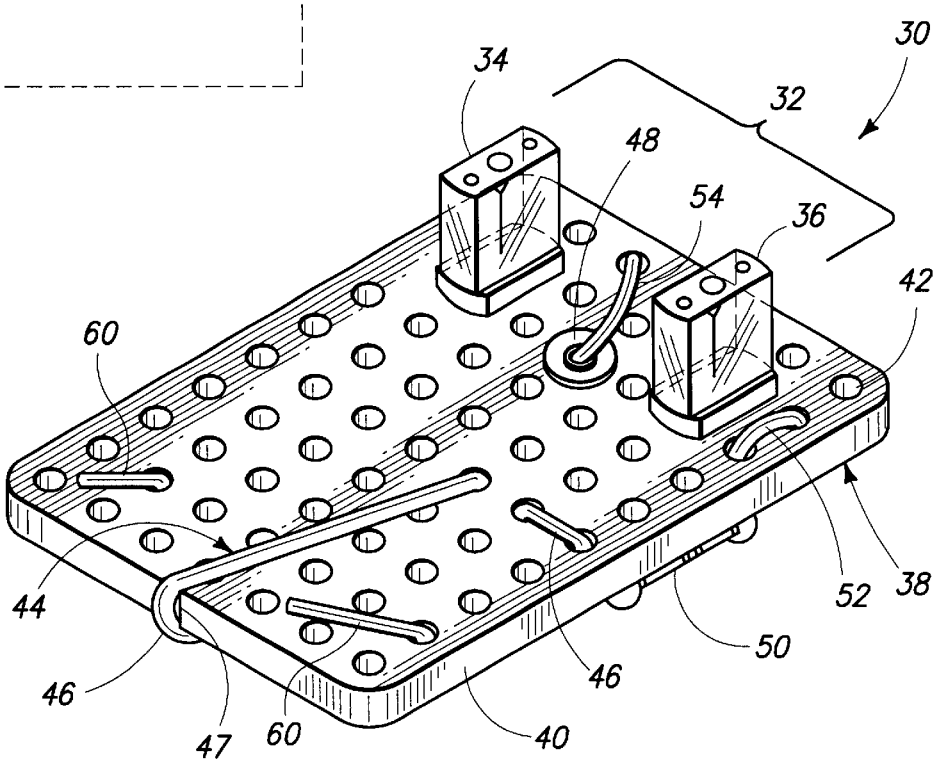
FIG. 2 is a perspective view of a portable lighting product provided for connection with a traditional 9-volt battery in accordance with one embodiment of this invention.
Figure 3:
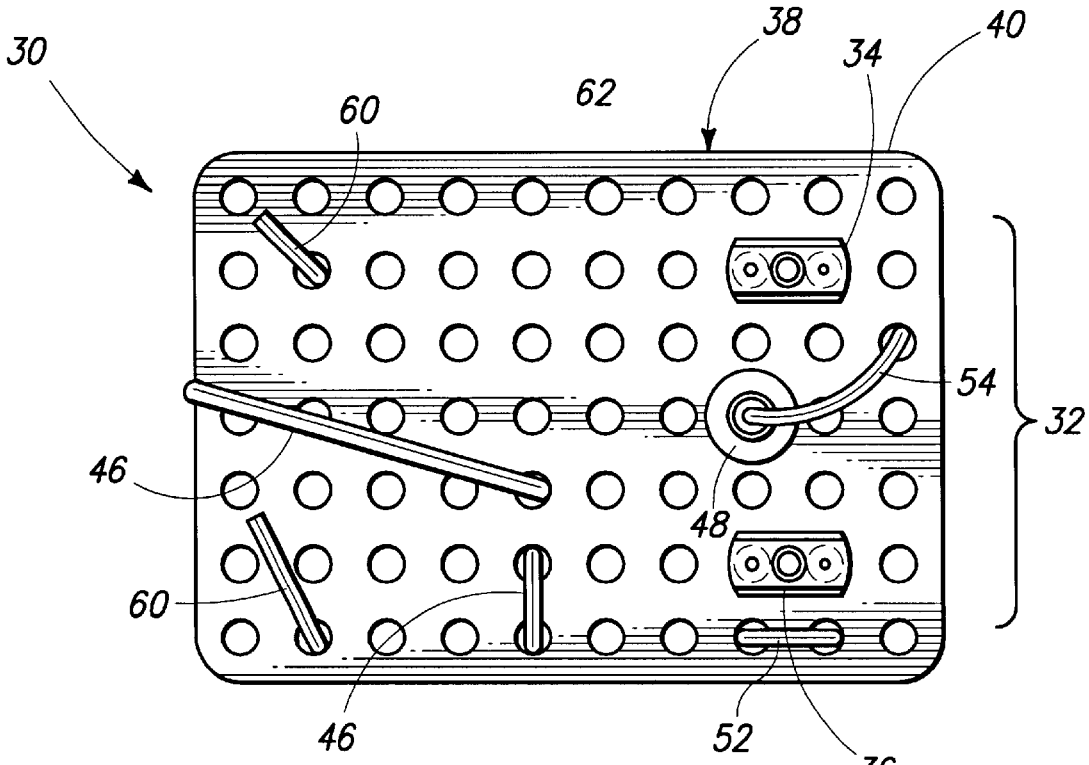
FIG. 3 is a top view of the portable lighting product of FIG. 2.

FIG. 2 is a perspective view illustrating a portable lighting product, or portable light, embodying Applicant's invention and designated generally with reference numeral 30. Portable light 30 includes a light source 32 that is powered by a battery 12 (see FIGS. 8–11). According to one construction, light source 32 comprises a pair of adjacent light-emitting diodes (LEDs) 34 and 36. One exemplary LED is a white light LED that combines a blue LED with YAG (yttrium, aluminum, garnet) yellow phosphor, as made by Nichia Corp. of Japan. LEDs 34, 36 are mounted onto a support member 38, such as a printed circuit (PC) board base 40. PC board base 40 includes a plurality of spaced-apart through-holes 42 through which circuitry 44 is routed and retained between top and bottom faces of base 40. One exemplary PC board is a peg board.

More particularly, circuitry 44 includes conductive wires 46, 52, and 54. As shown variously in FIGS. 2–6, circuitry 44 of portable light 30 also includes a resistor 50 placed in series with LEDs 34 and 36. Additional details of discrete components within circuitry 44 are illustrated with reference to FIG. 7, below.

Figure 5:
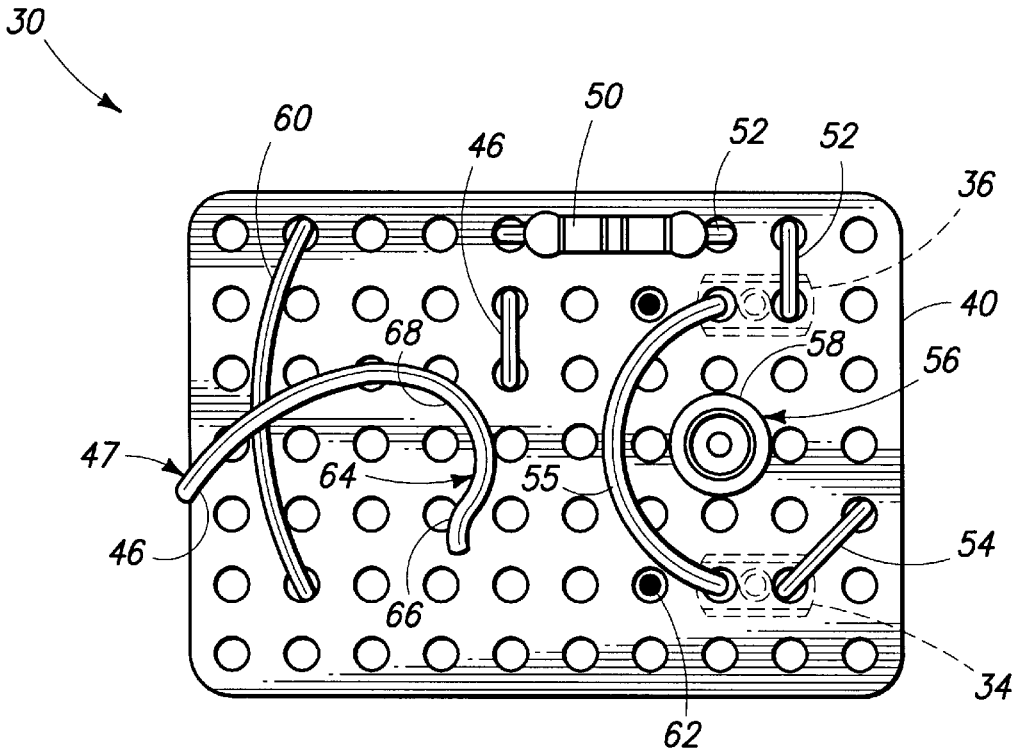
FIG. 5 is a bottom view of the portable lighting product of FIGS. 2–4.
Figure 6:
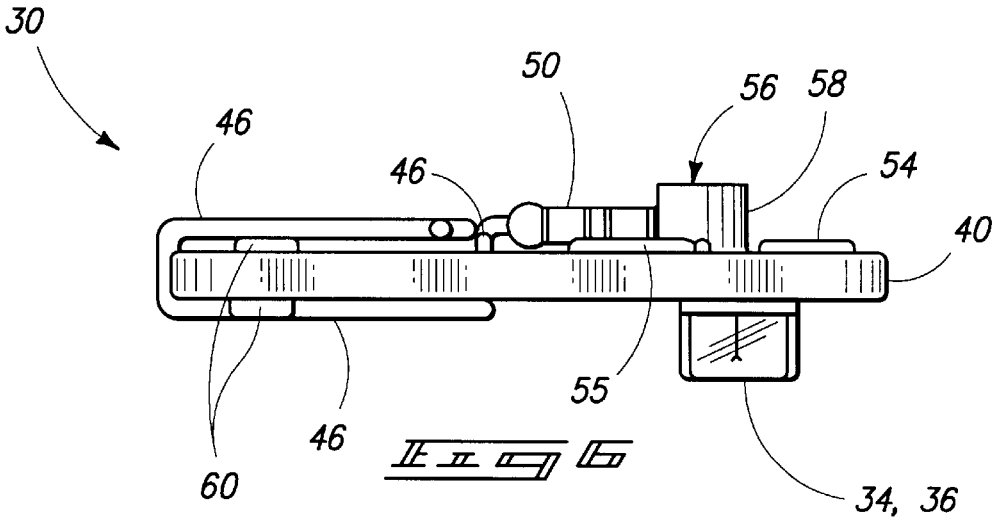
FIG. 6 is a front edge view of the portable lighting product relative to the view shown in FIG. 5.

As shown in FIGS. 5 and 6, a pivotable electrical connector 56 is provided on a bottom face of base 40. Connector 56 includes a base grommet 48 (see FIG. 3) to entrap electrical connector 56 onto base 40. More particularly, a male battery terminal 58 extends from one end of connector 56, in a direction opposite that of base grommet 48.

Conductive wire 46 is shown in FIG. 2 extending across a top face of base 40, down a grooved slot 47, and along an underside of base 40. As shown in FIG. 5, a spacer wire 60 is carried by PC board base 40 in order to raise a terminating end portion of conductive wire 46 away from a bottom face of base 40 to facilitate interconnection of wire 46 with a male battery terminal 18 on a conventional 9-volt battery 12 (see FIGS. 10 and 11). Additionally, a conductive wire 55 extends along a bottom surface of base 40, joining LEDs 34 and 36 in series.

A terminating portion of conductive wire 46 on the underside of base 40 provides an electrical contact clip 64, as shown in FIG. 5. More particularly, clip 64 terminates to form a hook 66 adjacent a concave contact portion 68.

When pivotal electrical connector 56 is mated with a complementary female battery terminal on a conventional 9-volt battery, hook 66 can be urged into engagement with a curved outer surface of a male battery terminal on such battery, urging hook 66 toward connector 56 until the male battery terminal clears hook 66 and is received within concave contact portion 68. The male battery terminal then maintains electrical contact with the concave contact portion 64, with hook 66 ensuring retention of portable light 30 in a "power on" configuration.

As shown in FIG. 5, wire 46 rotates slightly about slot 46 as hook 66 is urgably engaged against and over a male battery terminal on a battery in order to turn on the light source of the portable light. Similarly, rotation of portable light 30 relative to a battery causes hook 66 to be urged toward connector 56 until the male battery terminal leaves concave contact portion 66 and clears contact with hook 66. This configuration places such portable light 30 into a "power off" configuration when wire 46 no longer contacts the male battery terminal.

Figure 7:
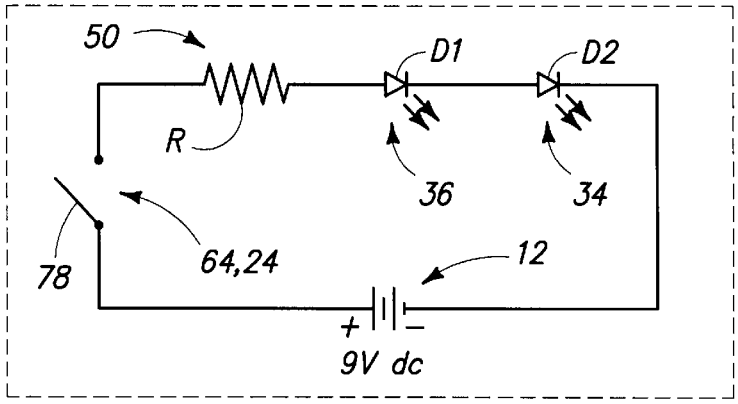
FIG. 7 is schematic circuit diagram for the portable lighting product of FIGS. 2–7.

FIG. 7 illustrates discrete components of the circuitry for the portable lighting product depicted in FIGS. 2–6. More particularly, a simplified circuit representation illustrates the placement of resistor 50 relative to LEDs 34 and 36, along with placement of battery 12 and a switch 78 comprising clip 64 interacting with male battery terminal 24.

Figure 10:
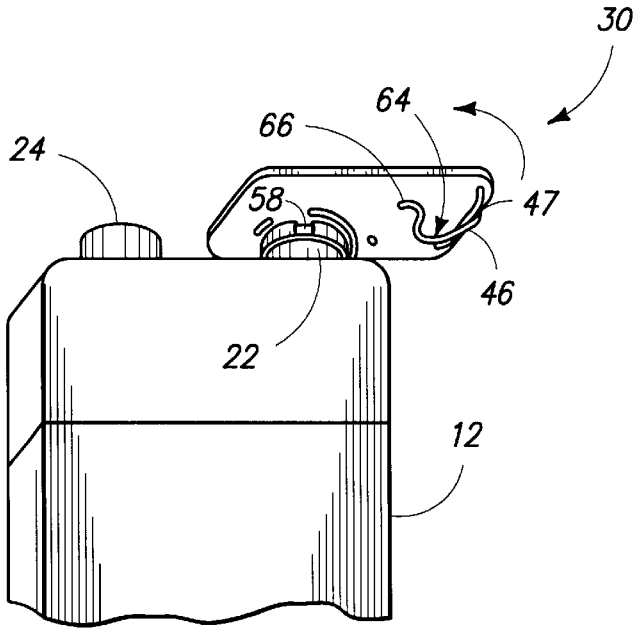
FIG. 10 is a fragmentary perspective view of the portable lighting product and battery of FIGS. 8–9 in an open switch configuration taken from an angle that illustrates orientation of the male battery terminal and clasp for the portable lighting product relative to the female and male battery terminals of the 9-volt battery while in a storage position.
Figure 11:
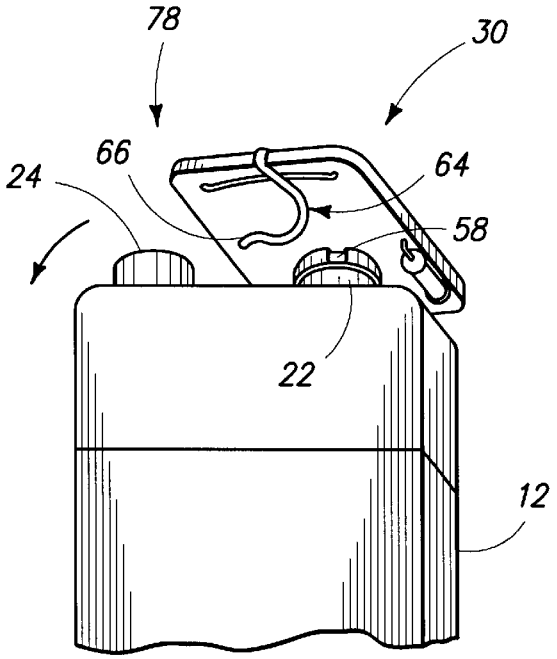
FIG. 11 is another fragmentary perspective view of the portable lighting product and battery of FIG. 10 showing the portable lighting product in an open switch configuration, but being further rotated toward a closed switch configuration than the configuration shown in FIG. 10.

As shown in FIG. 7, only discrete elements are depicted within the circuitry for the portable lighting product of FIGS. 2–6. However, it is understood that such circuitry also includes conductive wires 46, 52, 54, and 55 shown in FIGS. 2–5. Furthermore, switch 78 is identified as including clip 64 and battery terminal 24. However, switch 78 can also include base 40, male battery terminal 58 and female battery terminal 22 (as shown in FIGS. 2, 10 and 11). Optionally, switch 78 can be provided on a portable lighting product via base 40, pivotal electrical connector 56, and clip 64 which interact with an environment provided atop a traditional 9-volt battery to provide a switching function (see FIG. 5).

Accordingly, a switch mechanism is provided in series with an LED via conductor circuitry that includes such a pivotal electrical connector and a clip electrical connector. The pivotal electrical connector is configured to mate with a first battery terminal of a battery. The clip electrical connector is configured to mate and demate with a second battery terminal of a battery in response to rotation of the conductive circuitry (and an associated substrate or base) relative to the battery about the pivotal electrical connector. In such a case, the conductor circuitry is carried by the substrate and communicates with a positive lead and a negative lead of at least one light-emitting diode (LED). In one case, a pair of adjacent LEDs is provided on the substrate, or base. In a further limiting sense, in one case the base is provided by a printed circuit board that is configured to carry the pair of LEDs, the conductive circuitry, and the switch. In one case, the conductive circuitry includes conductive wire that is routed along the PC board in order to couple the LEDs via the switch with the first and second, adjacent battery terminals of a traditional 9-volt battery. In another case, the conductive circuitry comprises circuitry on a PC board, such as conductive copper traces and vias. Also in one case, a resistor is placed in series with the pair of LEDs to impedance match the circuitry at a desirable level.

Figure 8:
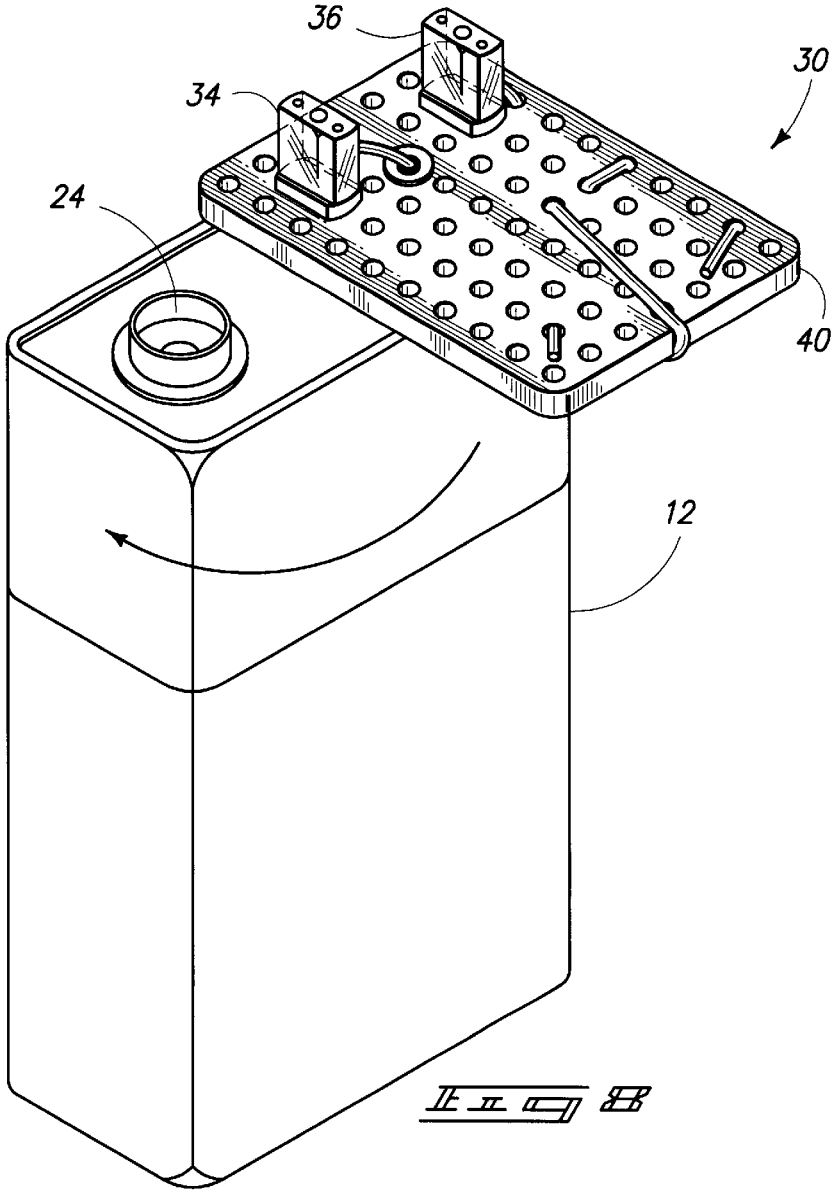
FIG. 8 is a perspective view illustrating the portable lighting product of FIGS. 2–7 mounted atop a 9-volt battery, and positioned in an open switch configuration corresponding with the portable lighting product being turned off.
Figure 9:
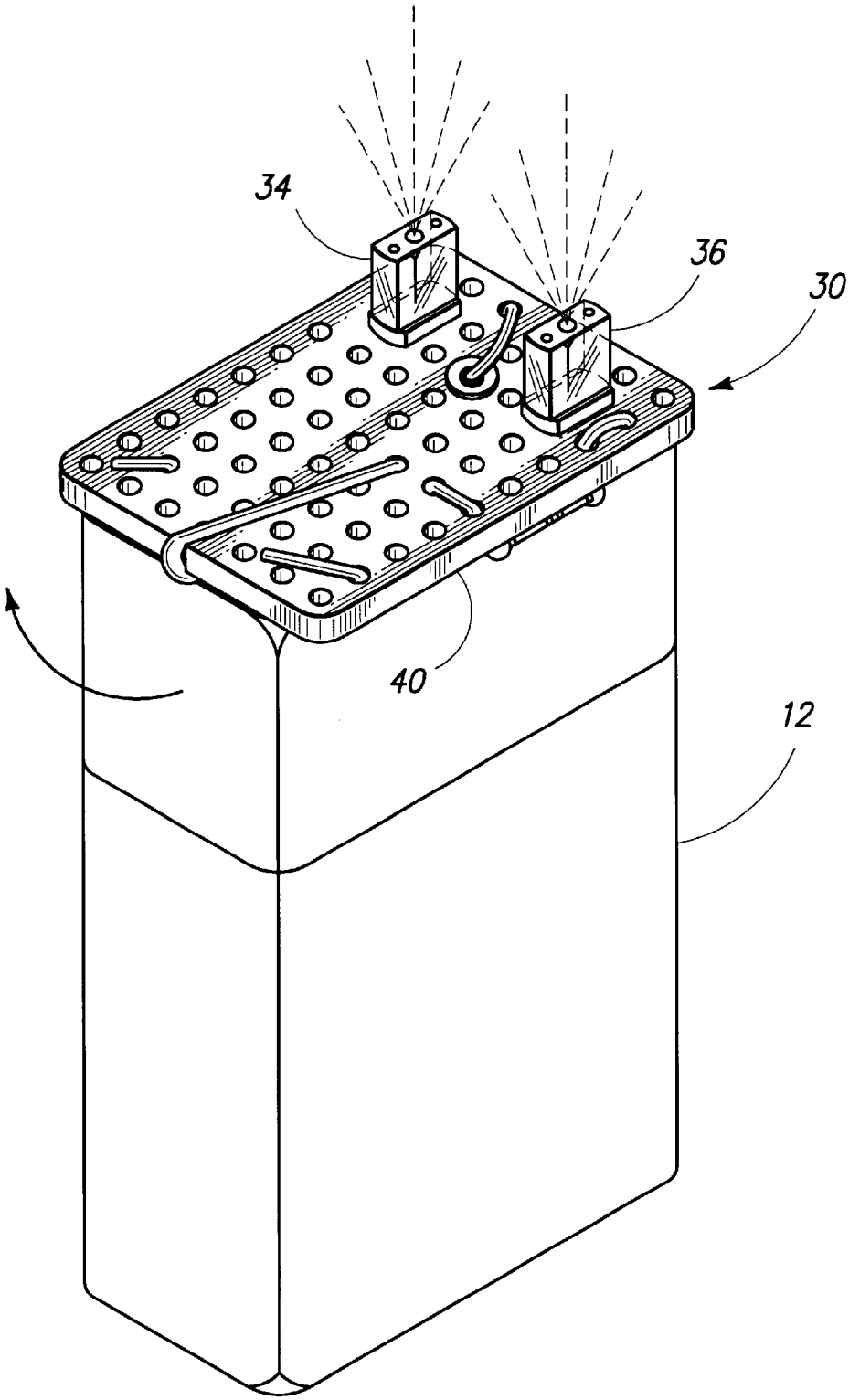

FIG. 8 depicts portable lighting product 30 in a configuration where product 30 is axially received in snap-fit engagement atop a conventional 9-volt battery 12, but showing portable light 30 in a "power-off" configuration. FIG. 9 corresponds with portable light 30 and battery 12 depicted in FIG. 8, but further illustrates the rotated positioning of portable light 30 atop battery 12 so as to configure portable light 30 in a "power-on" configuration.

The portable lighting product 30 of FIGS. 8 and 9 provides a safe alternative to utilizing candles during a power outage. One preferred packaging configuration includes providing the portable lighting product 30 and conventional 9-volt battery 12 of FIGS. 8 and 9 within a tight-fitting resealable plastic bag, such as a commercially available plastic sandwich or snack bag. By providing a tight-fitting plastic bag, the bag prevents accidentally turning on the portable lighting product relative to the battery. Furthermore, such bag provides a convenient display in packaging configuration for selling such portable lighting product along with a battery on a display within a store.

FIGS. 10 and 11 illustrate portable light 30 atop battery 12 in two different closed switch positions corresponding with rotation of portable light 30 atop battery 12 via relative rotation of female battery terminal 22 on battery 12 with respect to male battery terminal 58 of portable light 30. FIG. 10 illustrates an orientation that is desirable for storing light 30 and battery 12 in a "power off" configuration.

Figure 4:
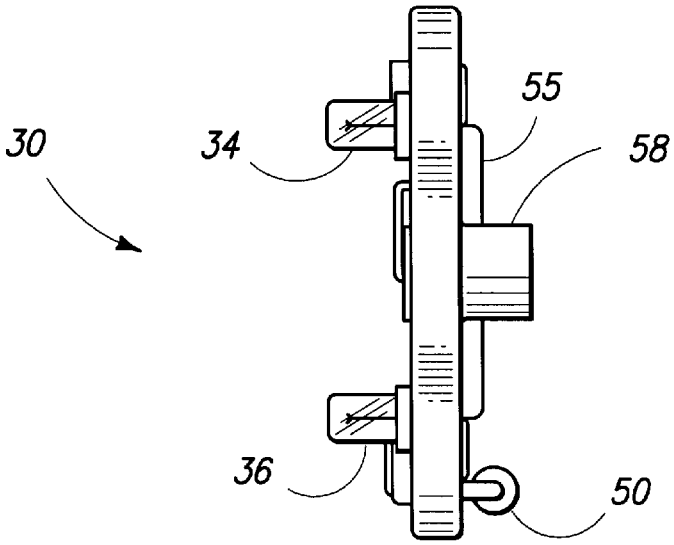
FIG. 4 is an edge view of the portable lighting product of FIGS. 2–3 taken from the right side of FIG. 3.

As was previously shown in FIGS. 4–6, male battery terminal 58 provides a pivotable electrical connector 56 when terminal 58 is axially mated in snap-fit engagement with a female battery terminal 22 of battery 12. Subsequent to mating of terminals 58 and 22, the orientation of clip 64 relative to male battery terminal 24 of battery 12 can clearly be seen in FIGS. 10 and 11.

Rotation of portable light 30 beyond the orientation depicted in FIG. 11 results in engagement of hook 66 with male connector 58 which causes clip 64 to snap into contact and engagement about the cylindrical post of male battery terminal 24. More particularly, wire 46 (see FIG. 10) of hook 66 elastically deforms sufficiently to cause hook 66 to override the outer surface of terminal 24. Subsequently, concave contact portion 68 settles into stable engagement with an outer surface of terminal 24. Accordingly, electrical connection is made between portable lighting product 30 and battery 12 to provide power supply to the light source of portable light 30. Interaction of male battery terminal 58 and clip 64 with the respective male battery terminal 24 and female battery 22 of a battery 12 provides an electrical switch 78 that enables the switched turning on and off of the light source on portable light 30.

In operation, portable light 30 provides a portable lighting product such as an electro-optical transducer including a lamp in a lamp holder. In one form, the lamp is an LED. As shown in FIG. 8, according to one embodiment the lamp holder comprises a base 40. According to such construction, the lamp holder has a positive terminal and a negative terminal spaced apart from the positive terminal for connection with respective terminals on a power source. One power source is provided by a battery 12. In one case, the PC board base 40 comprises a circuitry support member including circuitry for electrically coupling together each of a pair of leads on the lamp with a respective one of the terminals.

According to one configuration, the positive terminal is provided by male battery terminal 58 (see FIG. 10) and the negative terminal is provided in spaced-apart relation from the positive terminal by clip 64. The positive terminal and the negative terminal are each configured for connection with respective complementary terminals on a power source, or battery, 12. One of the terminals includes a snap-fitting, pivotable, and electrically conductive battery terminal, such as male battery terminal 58 (of FIG. 10). Another of the terminals comprises an electrically conductive clasp in one form depicted as clip 64 (of FIG. 10). The clasp is configured to mate in urgable engagement with a terminal of a power source. In one case, the lamp comprises a pair of LEDs 34 and 36 (see FIG. 8).

Figure 12:
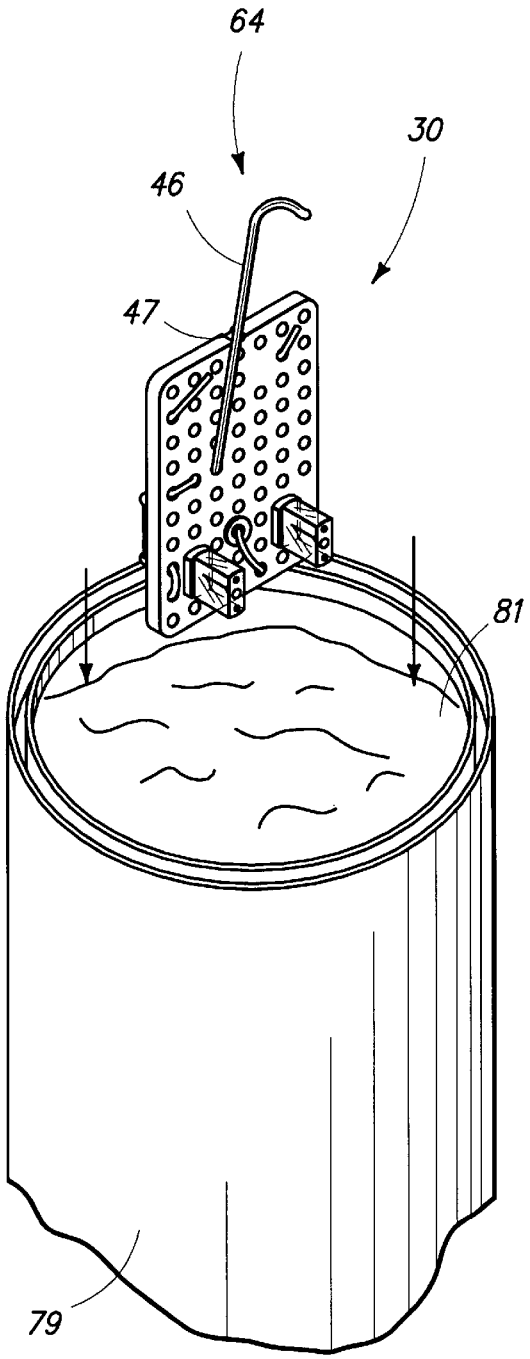
FIG. 12 is a fragmentary perspective view illustrating application of an insulative coating onto the portable lighting product of FIGS. 2–11 to provide insulative protection and/or advertising surface area atop the portable lighting product, according to a first alternative construction.
Figure 13:
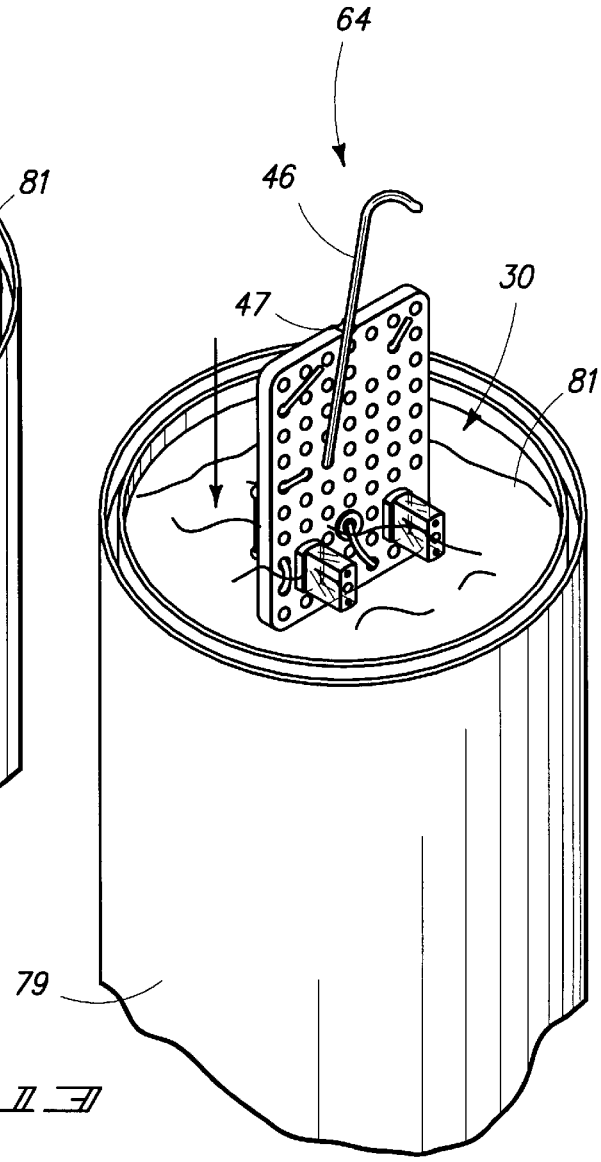
FIG. 13 is a fragmentary perspective view further illustrating application of the coating onto the portable lighting product of FIG. 12.

FIGS. 12 and 13 together illustrate a process for coating portable light 30 with a layer of insulative material, such as a resilient liquid rubber 81 contained in a vat 79, such as plastic dip, a flexible, synthetic rubber coating sold by Performix, of Blaine, Minn. Alternatively, liquid silicone can be used to coat selected circuitry and the PC board base of portable light 30.

Although not shown in FIGS. 12 and 13, it is understood that a cover similar to a female battery terminal is received over male battery terminal 58 during such dipping process, after which the liquid rubber hardens, and such material is removed locally from around the base of the cover using a sharp tool such as a razor blade. Subsequently, the cover and rubber coating is then removed from male battery terminal 58, exposing the male battery terminal 58. Similarly, the diodes of portable light are also preferably covered with protective covers, or caps, during the dipping operation, after which the solidified rubber material is cut from the base of the caps, after which the protective caps are removed from the diodes, thereby exposing the diodes externally to a user. It is further understood that, during the dipping operation, portable light 30 is submerged only sufficiently to completely cover the PC board base, and is not dipped far enough to cover wire 46 extending above and beyond slot 47.

After coating and drying the liquid rubber onto portable light 30, wire 46 is bent to extend within slot 47 and around the PC board base so as to overlie the bottom of the base. In this manner, the clip is provided along a bottom side of portable light 30. Hence, the resulting clip and section of wire 46 are not encased in the rubber material, but are exposed for electrical connection with a male battery terminal on a battery.

Figure 14:
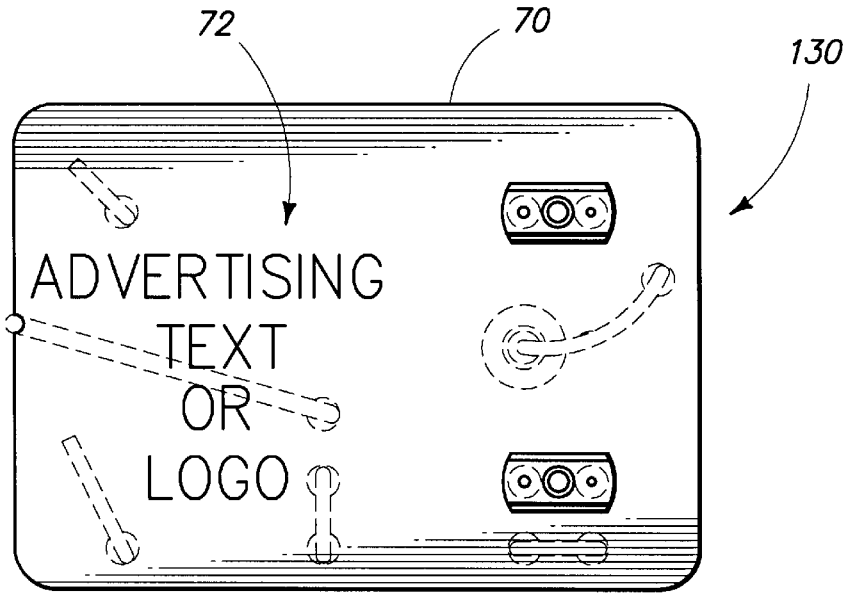
FIG. 14 is a top view of a portable lighting product of FIGS. 12–13 illustrating placement of printed advertising onto the coated top surface of the portable lighting product.

FIG. 14 illustrates placement of printed advertising 72 onto a coated top surface of portable lighting product 130 that has received a liquid rubber coating via the process depicted in FIGS. 12–13. One reason for coating portable light 130 is to deliver a relatively flat surface area onto which printed advertising in the form of indicia and/or logos 72 can be applied with ink or paint onto the topmost surface of the portable light 130.

Figure 15:
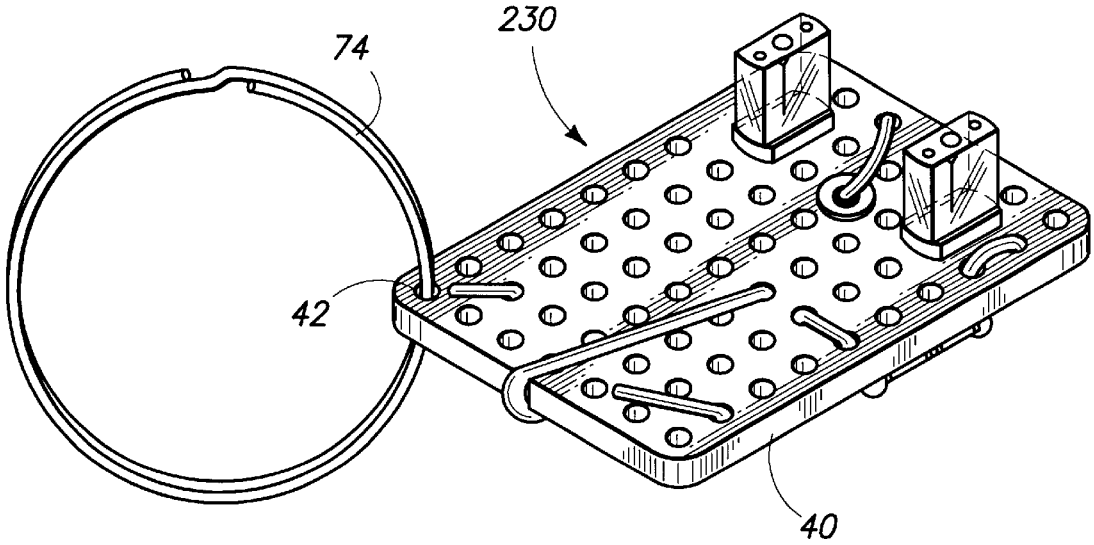
FIG. 15 is a perspective view of a key chain embodiment of the portable lighting product of FIGS. 2–11, according to a third alternative construction.

FIG. 15 illustrates a third alternative construction of Applicant's invention comprising a portable light 230 that is carried on a key ring 74 that has been received within through-hole 42 in one corner of the PC board base of portable light 230. Hence, light 230 provides the ability to illuminate keys when using them in dark locations.

Figure 16:
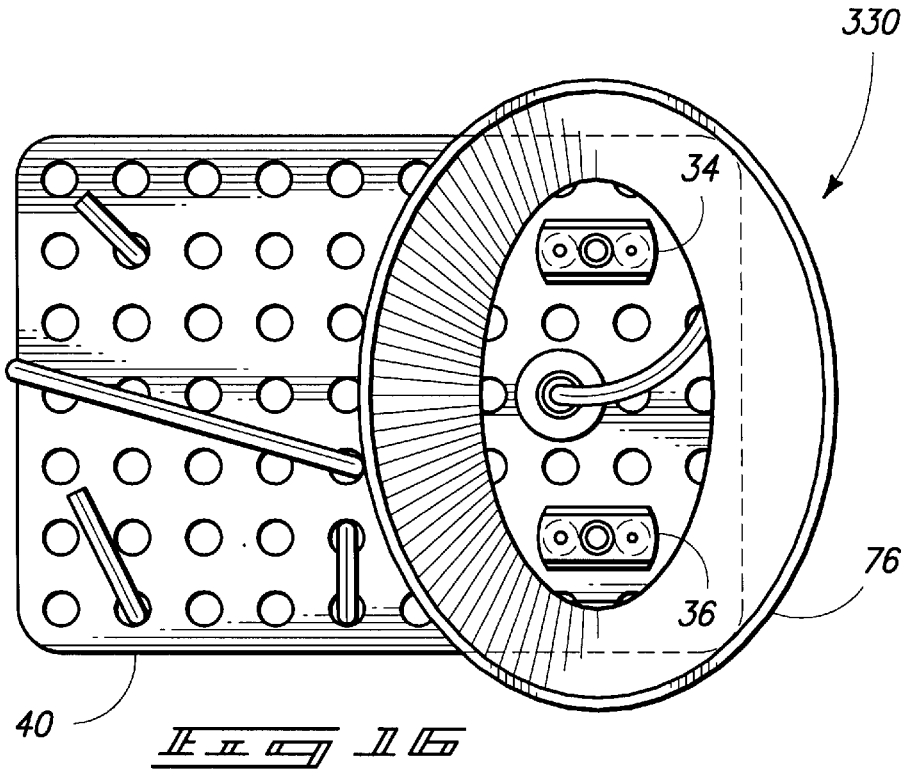
FIG. 16 is a top view of a fourth alternative construction of the portable lighting product of FIGS. 2–11 having an optical reflector.
Figure 17:
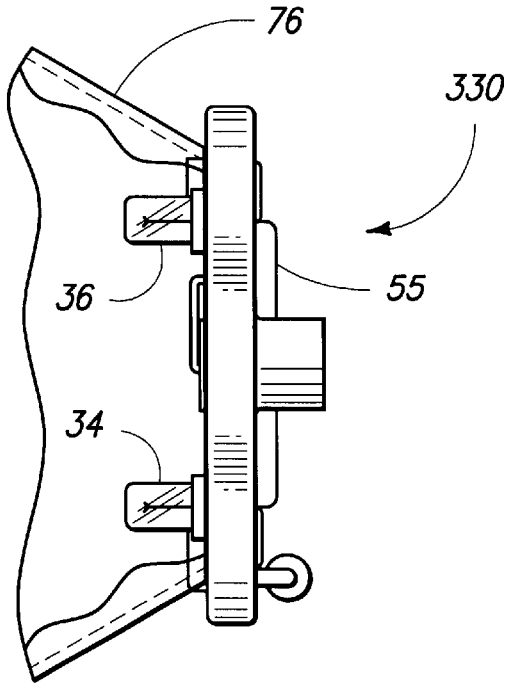
FIG. 17 is a right side partial breakaway view of the portable lighting product of FIG. 15 illustrating the reflector in partial breakaway.
Figure 18:
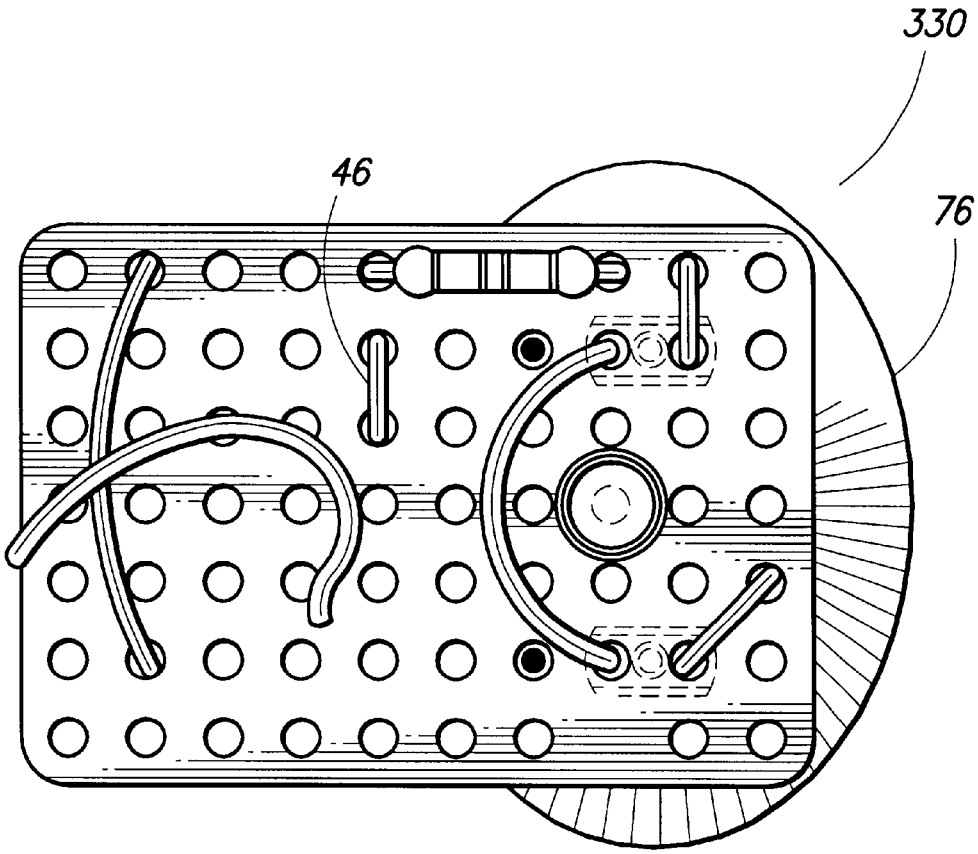
FIG. 18 is a bottom view of the portable lighting product of FIGS. 15–16.
Figure 19:
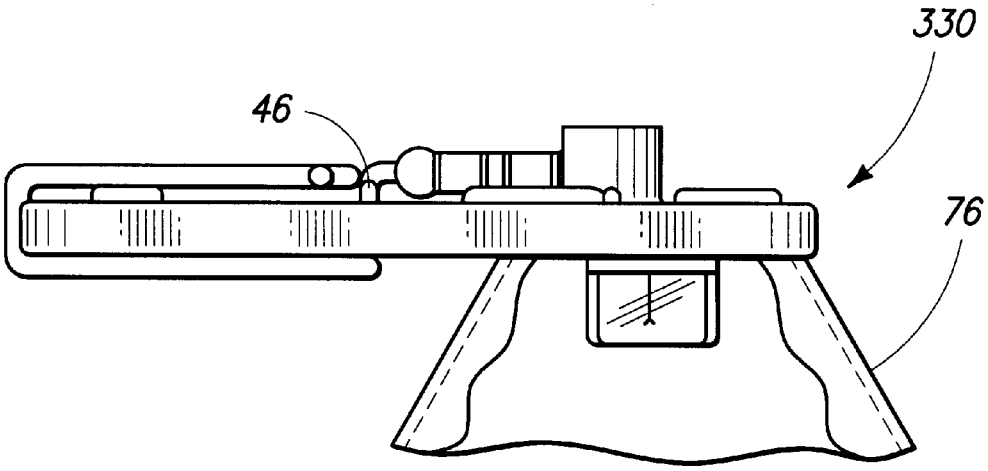
FIG. 19 is a front edge partial breakaway view of the portable lighting product relative to the view shown in FIG. 17.

FIG. 16 is the fourth alternative construction, similar to that depicted in FIGS. 2–11, of a portable light 330 including an elliptical reflector 76 mounted on a top face of PC board base 40, about LEDs 34 and 36. FIGS. 17–19 depict various additional views of such reflector 76 on portable light 330.

Preferably, reflector 76 is adhesively bonded onto a top surface of PC board base 40 using a thin bead of epoxy. According to one construction, elliptical reflector 76 has a modified frustoconical shape that mates smoothly with a relatively planar surface of base 40.

Figure 20:
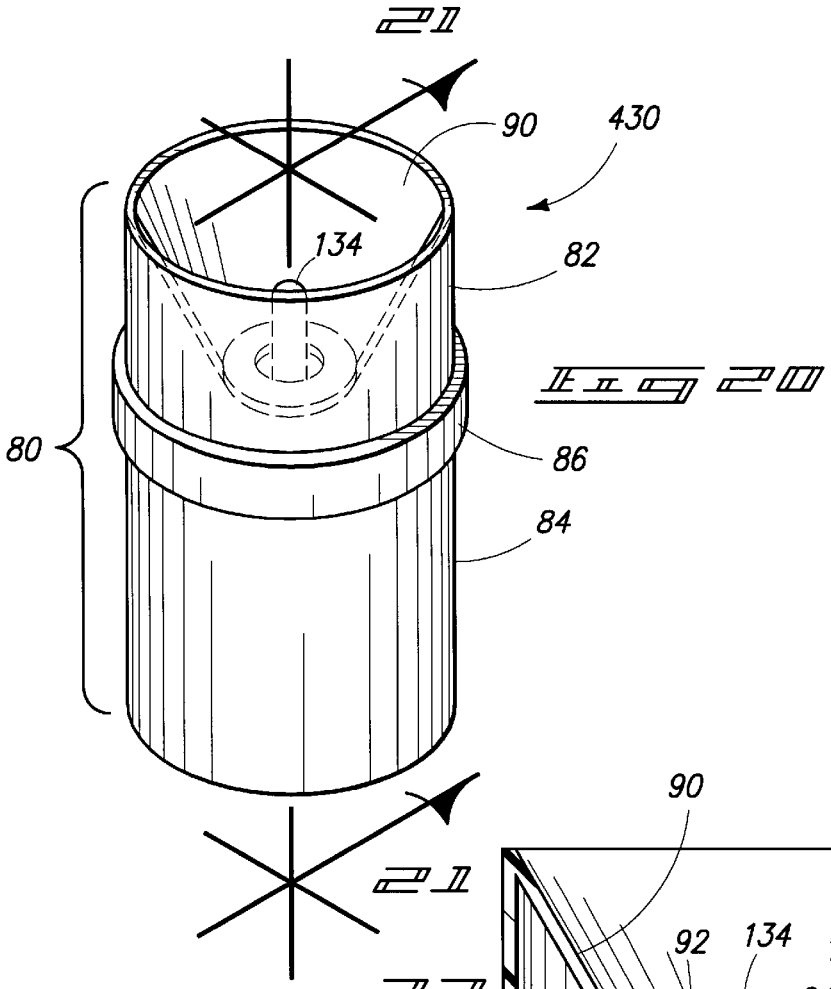
FIG. 20 is a perspective view of a fifth alternative embodiment portable lighting product having a housing with a reflector.
Figure 21:
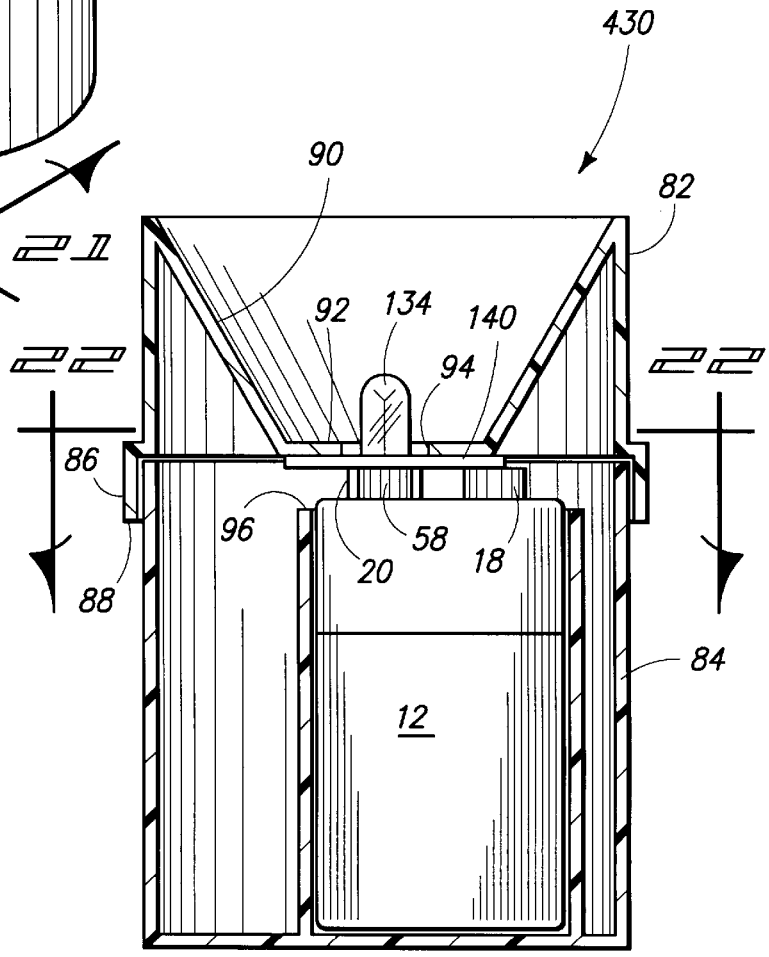
FIG. 21 is a vertical centerline sectional view of the portable lighting product of FIG. 20 illustrating battery containment within the housing.

FIGS. 20–24 illustrate a fifth alternative embodiment for a portable lighting product, or portable light, 430 that includes a housing 80. As shown in FIG. 20, housing 80 of portable light 430 includes a cap 82 that is received for rotation about a cylindrical base 84. Relative rotation between cap 82 and base 84 is controlled by a cylindrical flange 86 of cap 82 that encircles and surrounds base 84 with sufficient clearance so as to enable unrestricted rotation of cap 82 relative to base 84. An open end of cylindrical flange 86 defines a cylindrical end portion 88, as seen in FIG. 21. A top surface of cap 82 forms a frustoconical reflector 90 in which a light-emitting diode (LED) 134 is presented for illumination.

As shown in FIG. 21, a bottom portion of frustoconical reflector 90 terminates in a reflector base 92 having an oversized aperture 94 that receives LED 134 to provide a slight clearance gap around LED 134. A rectangular battery housing 96 is molded as a single unit within base 84 for receiving a traditional 9-volt battery of rectangular cross-sectional shape. Battery housing 96 is offset from a center axis of cylindrical base 84 so as to present a male battery terminal 24 of a battery 12 that is received therein coincident with the center axis of base 84.

An LED 134 is provided on a PC board base 140 (similar to PC board base 40) which also includes a male battery terminal 58. Terminal 24 is configured for axial, snap-fit engagement with female battery terminal 20. It is understood that base 140 includes similar circuitry to the embodiment depicted in FIGS. 2–11, wherein male battery terminal 58 secures a battery 12 for pivotal motion onto and in relation with PC board base 140. Male battery terminal 18 of battery 12 is then brought into engagement with one of two selected spring clips 98 and 100 (see FIGS. 22–24) in order to turn power on and off to diode 134.

As shown in FIG. 21, battery housing 96 is sized to snugly receive battery 12 therein with sufficient resistance that coupling between female battery terminal 20 and male battery terminal 58 serves as the sole axial retention mechanism for retaining cap 82 onto base 84. Additionally, cylindrical flange 86 serves to center cap 82 for rotation about base 84. Preferably, base 140 is adhesively glued to an underside of reflector base 92 using an epoxy adhesive.

Figure 22:
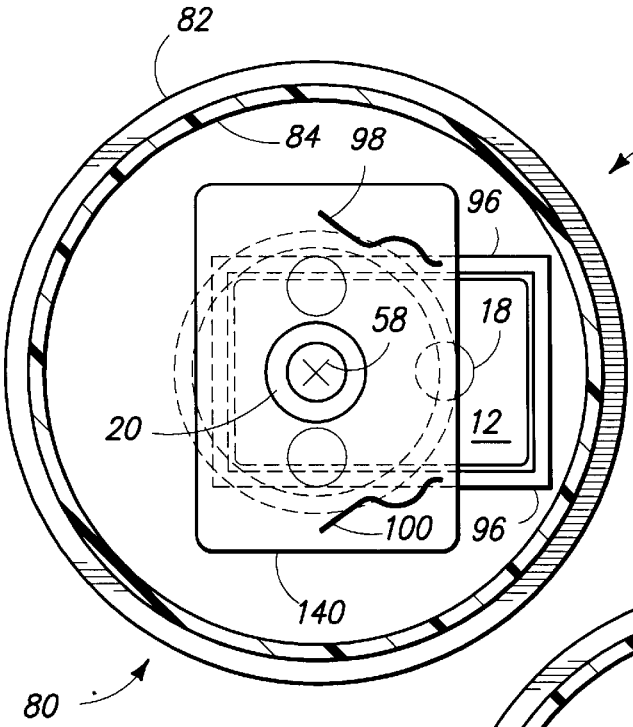
FIG. 22 is a cross-sectional view taken along line 22—22 of FIG. 21 showing the portable lighting product configured with the switch in an intermediate position between a latched open switch position and a latched closed switch position.
Figure 23:
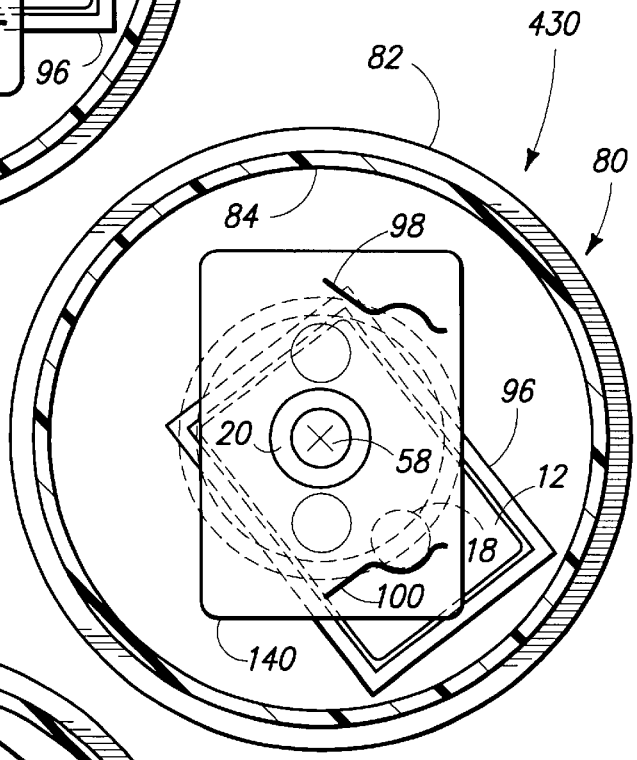
FIG. 23 is a view corresponding with that shown in FIG. 22, but illustrating the switch in an open (or off) position.
Figure 24:
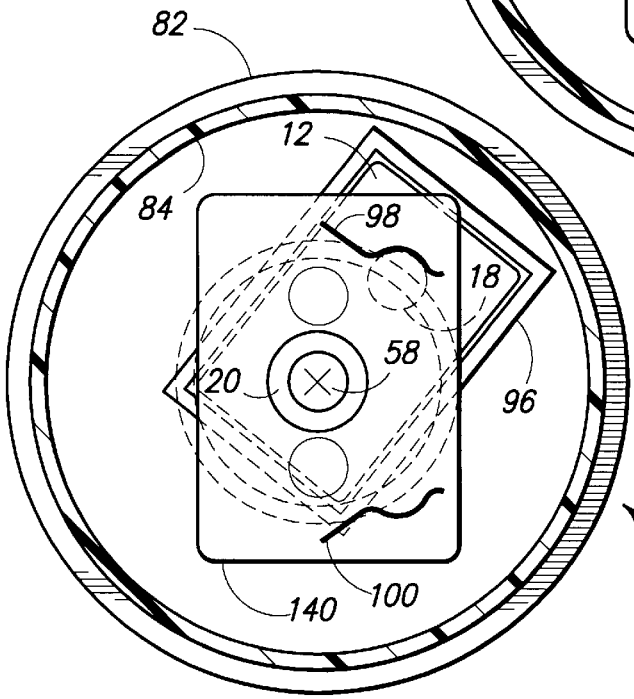
FIG. 24 is a view corresponding with that shown in FIG. 22, but illustrating the switch in a closed (or on) position.

FIG. 22 is a cross-sectional view taken along line 22—22 of FIG. 21 illustrating the relative positioning of cap 82 and base 84 so that battery 12 is placed with male battery terminal 18 in an intermediate position between electrically conductive spring clip 98 and electrically isolated spring clip 100. Spring clip 98 is electrically affixed in conductive relation with male battery terminal 58 via a resistor (not shown), using circuitry similar to that depicted in the embodiment of FIG. 7. Accordingly, rotation of battery 12 and male battery terminal 18 into urgable engagement with spring clip 100 ensures that portable light 430 is configured in a "power-off" mode (the LED is turned off). Likewise, rotation of cap 82 relative to base 84 to position battery 12 with male battery terminal 18 in clipped engagement with spring clip 98 (as shown in FIG. 24) turns on the corresponding LED and illustrates the "power-on" mode.

As was the case with the earlier embodiment, pivotal cooperation between female battery terminal 20 and male battery 58 of portable light 430 provides for electrical switching between male battery terminal 18 and electrically connected spring clip 98. Spring clip 100 merely ensures that portable light 430 is rotated into a stable "power-off" configuration.

Figure 25:
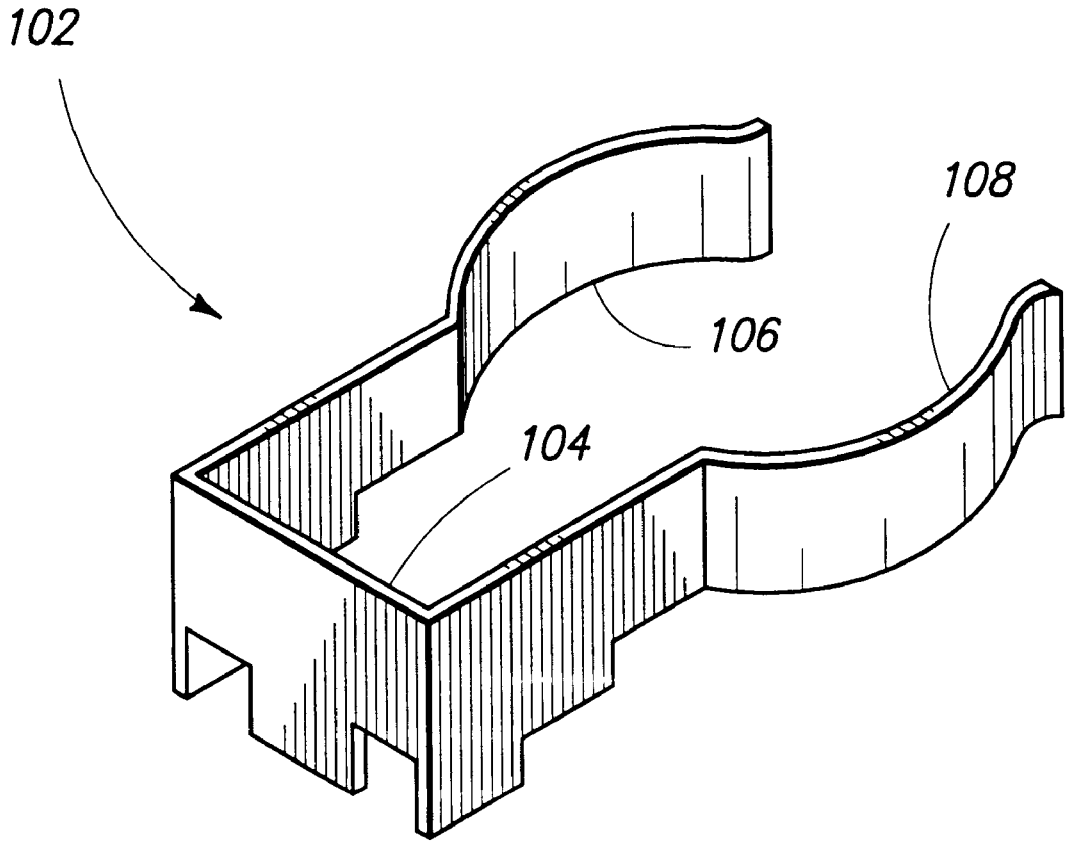
FIG. 25 is a perspective view of an alternative construction for a contact clip for the portable lighting product of FIGS. 20–24.

FIG. 25 illustrates an alternatively constructed spring clip 102 that can be utilized to replace spring clips 98 and 100. More particularly, spring clip 102 is formed from stamped spring steel, and includes a base portion 104 and a pair of opposed arcuate clips 106 and 108. Clip 102 can also be substituted for the wire clip 64 depicted in FIGS. 2–11.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A portable lighting product, comprising:

a lamp;

a lamp holder having a positive terminal and a negative terminal spaced from the positive terminal for connection with respective terminals on a power source;

one of the terminals comprising a snap-fitting, pivotable, and electrically conductive battery terminal; and another of the terminals comprising an electrically conductive clasp configured to mate in urgable engagement with a terminal of a power source.

2. The portable lighting product of claim 1 wherein the lamp comprises at least one light emitting diode (LED).

3. The portable lighting product of claim 1 wherein the lamp holder comprises a support member formed from printed circuit (PC) board.

4. The portable lighting product of claim 1 wherein the lamp holder comprises a circuitry support member including circuitry for electrically coupling together each of a pair of leads on the lamp with a respective one of the terminals.

5. The portable lighting product of claim 4 wherein the lamp holder comprises a printed circuit (PC) board and the circuitry comprises conductive wire routed through holes in the PC board.

6. The portable lighting product of claim 5 wherein the circuitry further comprises a resistor placed in series with the lamp.

7. The portable lighting product of claim 6 wherein the lamp comprises at least one light emitting diode (LED) carried by the PC board.

8. The portable lighting product of claim 1 wherein the one terminal comprises a male battery terminal for a 9-volt battery.

9. The portable lighting product of claim 1 wherein the clasp of the another terminal comprises a contact clip having a hook and a concave contact portion for electrically and mechanically mating with a male battery terminal of a 9-volt battery.

10. A portable lighting product, comprising:

a light source having a pair of electrical leads;

a pivotal electrical connector communicating with a first electrical lead and configured to axially mate with a first battery terminal of a power supply;

a clip electrical connector spaced from the pivotal electrical connector and communicating with a second electrical lead and configured to mate and demate with a second battery terminal of a power supply; and corresponding with pivoting of the pivotal electrical connector a support member carrying the pivotal electrical connector, the clip electrical connector, and the light source.

11. The portable lighting product of claim 10 wherein the light source comprises at least one light emitting diode (LED).

12. The portable lighting product of claim 10 wherein the support member comprises a printed circuit (PC) board.

13. The portable lighting product of claim 12 further comprising wire circuitry provided on the PC board for interconnecting the light source and electrical connectors, wherein the PC board is coated with an insulating material.

14. The portable lighting product of claim 13 wherein advertising indicia is provided on the insulating material.

15. The portable lighting product of claim 10 wherein the pivotal electrical connector comprises a male electrical connector configured for complementary mating with a female battery terminal of a conventional 9-volt battery.

16. The portable lighting product of claim 10 wherein the clip electrical connector comprises a conductive wire having a hook at a terminal end and a concave contact portion configured for complementary mating and demating with a male battery terminal of a conventional 9-volt battery.

17. The portable lighting product of claim 10 further comprising a housing, wherein the support member is carried within the housing.

18. Portable lighting product circuitry, comprising:

at least one light emitting diode (LED) having a positive lead and a negative lead;

conductive circuitry carried by a substrate and communicating with the positive lead and the negative lead; and a switch mechanism in series with the LED via the conductive circuitry including a pivotal electrical connector configured to mate with a first battery terminal of a battery and a clip electrical connector configured to mate and demate with a second battery terminal of a battery responsive to rotation of the conductive circuitry and substrate relative to the battery about the pivotal electrical connector.

19. The portable lighting product circuitry of claim 18 wherein at least one LED comprises a pair of adjacent LEDs.

20. The portable lighting product circuitry of claim 18 further comprising a printer circuit (PC) board configured to carry the at least one LED, the conductive circuitry, and the switch.

21. The portable lighting product circuitry of claim 20 wherein the conductive circuitry comprises wire routed along the PC board to couple the at least one LED via the switch with the first and second, adjacent battery terminals of the battery.

22. The portable lighting product circuitry of claim 21 further comprising a resistor placed in series with the at least one LED.

23. A method for operating portable lighting product circuitry, comprising:

providing a portable lighting product including a lamp on a support member having a pivotable battery terminal and a conductive clasp spaced from the battery terminal, the battery terminal mated in urgable engagement with a female battery terminal of a battery also having a second battery terminal spaced-apart from the female battery terminal; and changing an operating state of the portable lighting product between on and off by rotating the portable lighting product relative to the battery about the pivotable battery terminal to engage and disengage the clasp with the second battery terminal of the battery.

24. The method of claim 23 wherein the pivotable battery terminal is a snap-on battery terminal for mating with a complementary battery terminal of a traditional 9-volt battery.

25. The method of claim 24 wherein the pivotable battery terminal is a male battery terminal.

26. The method of claim 23 wherein the clasp comprises a wire form clip retained at one end of the support member and having a hook at an opposite, free end adjacent a concave contact portion.

27. The method of claim 26 further comprising forcibly urging the clip away from the pivotable battery terminal responsive to engaging the clip with the second battery terminal of the battery.

28. The method of claim 23 wherein the lamp comprises at least one light emitting diode (LED).

29. A portable lighting product for an electrical power source having snap terminals, comprising:

an electro-optical transducer;

a structural member to support the electro-optical transducer;

one mating terminal for mating with one snap terminal of the power source;

another mating terminal for mating and demating with another snap terminal of the power source; and connective circuitry carried by the structural member for connecting the electro-optical transducer with the one mating terminal and the another mating terminal;

wherein the structural member is pivotably free about an axis of the one snap terminal via the one mating terminal;

and wherein the structural member includes a switch for opening and closing a circuit with the another mating terminal by pivoting the structural member about the one snap terminal to mate and demate respectively the another mating terminal with the another snap terminal of the power source.

30. The portable lighting product of claim 29 wherein the electro-optical transducer comprises at least one light emitting diode (LED).

31. The portable lighting product of claim 29 wherein the structural member comprises a printed circuit (PC) board.

32. The portable lighting product of claim 29 wherein the connection circuitry comprises point-to-point conductive wire and the structural member comprises peg board.

33. The portable lighting product of claim 29 wherein the structural member comprises a printed circuit (PC) board and the connection circuitry comprises printed circuits on the PC board.

* * * * *

UNITED STATES PATENT AND TRADEMARK OFFICE

CERTIFICATE OF CORRECTION

PATENT NO. : 6,695,459 B2
DATED : February 24, 2004
INVENTOR(S) : John Collins

It is certified that error appears in the above-identified patent and that said Letters Patent is hereby corrected as shown below:

Column 3,
Line 7, delete "Fig. 7 is schematic" and insert -- Fig. 7 is a schematic --.

Column 5,
Line 9, delete "about slot 46" and insert -- about slot 47 --.
Line 15, delete "portion 66 and clears" and insert -- portion 68 and clears --.

Column 7,
Line 20, delete "portable light are also" and insert -- portable light 30 are also --.

Column 8,
Line 57, delete "portable light are also" and insert -- portable light 30 are also --.

Column 9,
Line 17, "one of the terminals" and insert -- one of the positive terminal and the negative terminal --.
Line 19, delete "another of the terminals" and insert -- another of the positive terminal and the negative terminal --.
Line 21, after "power source" insert -- , corresponding with pivoting of the one terminal --.
Line 57, delete "power supply; and" and insert -- power supply corresponding with pivoting of the pivotal electrical connector; and --.

Column 10,
Line 36, delete "a printer circuit (PC) board" and insert -- a printed circuit (PC) board" and insert -- a printed circuit (PC) board --.

Signed and Sealed this

Fifteenth Day of June, 2004

JON W. DUDAS
*Acting Director of the United States Patent and Trademark Office*